US007915580B2

(12) United States Patent
Splendore et al.

(10) Patent No.: US 7,915,580 B2
(45) Date of Patent: Mar. 29, 2011

(54) ELECTRO-DYNAMIC OR ELECTRO-STATIC LENS COUPLED TO A STACKED RING ION GUIDE

(75) Inventors: Maurizio A. Splendore, Walnut Creek, CA (US); Eloy R. Wouters, San Jose, CA (US); Michael W. Senko, Sunnyvale, CA (US); Paul R. Atherton, San Jose, CA (US); Jean Jacques Dunyach, San Jose, CA (US); Christopher Mullen, Menlo Park, CA (US)

(73) Assignee: Thermo Finnigan LLC, San Jose, CA (US)

( * ) Notice: Subject to any disclaimer, the term of this patent is extended or adjusted under 35 U.S.C. 154(b) by 370 days.

(21) Appl. No.: 12/252,013

(22) Filed: Oct. 15, 2008

(65) Prior Publication Data

US 2010/0090104 A1 Apr. 15, 2010

(51) Int. Cl.
*H01J 49/06* (2006.01)

(52) U.S. Cl. ..... 250/288; 250/281; 250/282; 250/290; 250/292

(58) Field of Classification Search ..... None
See application file for complete search history.

(56) References Cited

U.S. PATENT DOCUMENTS

| | | | | |
|---|---|---|---|---|
| 6,107,628 | A * | 8/2000 | Smith et al. | 250/292 |
| 6,417,511 | B1 | 7/2002 | Russ, IV et al. | |
| 6,583,408 | B2 | 6/2003 | Smith et al. | |
| 6,727,495 | B2 | 4/2004 | Li | |
| 6,891,153 | B2 | 5/2005 | Bateman et al. | |
| 7,064,321 | B2 | 6/2006 | Franzen | |
| 7,459,693 | B2 * | 12/2008 | Park et al. | 250/423 R |
| 7,514,673 | B2 * | 4/2009 | Senko et al. | 250/281 |
| 2005/0279931 | A1 | 12/2005 | Franzen et al. | |

FOREIGN PATENT DOCUMENTS

| | | | |
|---|---|---|---|
| EP | 1 465 234 | A3 | 4/2006 |
| GB | 2 429 579 | A | 2/2007 |
| WO | WO 2008/157019 | A2 | 12/2008 |

OTHER PUBLICATIONS

K. Giles et al., "Evaluation of a Stacked-Ring Radio Frequency Ion Transmission Device at Intermediate Pressures," Proceedings of the 49th ASMS Conference on Mass Spectrometry and Allied Topics, Chicago IL (May 27-31, 2001), pp. 1-2.

Kevin Giles et al., "Applications of a Travelling Wave-Based Radio-Frequency-Only Stacked Ring Ion Guide," Rapid Communications in Mass Spectrometry, www.interscience.wiley.com, pp. 2401-2414, (2004).

Guan et al., "Stacked-Ring Electrostatic Ion Guide," American Society for Mass Spectrometry (7), pp. 101-106, (1996).

Julian et al., "Ion Funnels for the Masses: Experiments and Simulations with a Simplified Ion Funnel," American Society for Mass Spectrometry (16), Elsevier, Inc., pp. 1708-1712, (2005).

* cited by examiner

*Primary Examiner* — Jack I Berman
(74) *Attorney, Agent, or Firm* — Michael C. Staggs

(57) ABSTRACT

A device for improved transportation and focusing of ions in a low vacuum or atmospheric-pressure region of a mass spectrometer is constructed from one or more electro-dynamic or electrostatic focusing lenses that is/are coupled to the first electrode of a stacked ring ion guide (SRIG) to which oscillatory (e.g., radio-frequency) voltages are applied. Such configurations as disclosed herein, minimizes deleterious field effects and/or repositioning problems of desired ion transfer instruments that utilize such stacked ring ion guides by generally configuring the outlet end of the ion transfer device to a desired position within the electro-dynamic or electro-static focusing lens(es).

46 Claims, 3 Drawing Sheets

ELECTRO-DYNAMIC OR ELECTRO-STATIC LENS COUPLED TO A STACKED RING ION GUIDE

FIELD OF THE INVENTION

The present invention relates generally to ion optics for mass spectrometers, and more particularly to a device for confining and focusing ions, while minimizing harmful field effects, in a low vacuum region.

BACKGROUND OF THE INVENTION

A fundamental challenge faced by designers of mass spectrometers is the efficient transport of ions from the ion source to the mass analyzer, particularly through atmospheric or low vacuum regions where ion motion is substantially influenced by interaction with background gas molecules. If stacked electrode structures are used in the first vacuum region after ion introduction via, for example, an ion transfer tube and the ion transfer tube is too short, i.e., it ends before the thickness of the first electrode of such a structure, ions at the entrance experience strong fields which are often detrimental to the transmission of one or more multiply charged ions. It is to be appreciated that even a small manufacturing tolerance of less than about 0.002 inches in the length of the ion transfer tube can cause large transmission losses for multiply charged ions. Another issue arises when the ion transfer tube, after being temporarily removed for cleaning, is repositioned at a slightly different distance with the first electrode, which can cause large differences of the multiply charged ions.

Background information on a lens design for focusing ions is described in U.S. Pat. No. 5,157,260, entitled "Method and Apparatus for Focusing Ions in Viscous Flow Jet Expansion Region of an Electrospray Apparatus," to Mylchreest et al., issued Oct. 20, 1992, including the following: "In summary, the function of the tube lens is to shape the electric fields in this region so that the ions are forced down the jet centerline, thus increasing the ion fraction captured by the mass spectrometer. Not only is the ion beam intensified by the focusing action of the lens; but another beneficial effect is the divergence angle of the ion beam after the skimmer is narrower than expected from a free jet expansion. It is believed that this reduced divergence occurs because the strong electric field gradients on the upstream side of the skimmer propel the ions through the orifice at a velocity several times faster than the gas velocity. This means the ion trajectories downstream of the orifice are more influenced by these gradients than by the gas expansion from the skimmer. We have found that use of a tube lens has increased transmission of ions into the analyzer by at least a factor of three."

Background information on stacked electrode structures configured as an ion funnel to manipulate ions can be found in U.S. Pat. No. 6,107,628 to Smith et al. Generally described, the device described therein includes a multitude of closely longitudinally spaced ring electrodes having apertures that decrease in size from the entrance of the device to its exit. The electrodes are electrically isolated from each other, and radio-frequency (RF) voltages are applied to the electrodes in a prescribed phase relationship to radially confine the ions to the interior of the device. The relatively large aperture size at the device entrance provides for a large ion acceptance area, and the progressively reduced aperture size creates a "tapered" RF field having a field-free zone that decreases in diameter along the direction of ion travel, thereby focusing ions to a narrow beam which may then be passed through the aperture of a skimmer or other electrostatic lens without incurring a large degree of ion losses. Refinements to and variations on such a device are described in (for example) U.S. Pat. No. 6,583,408 to Smith et al., U.S. Pat. No. 7,064,321 to Franzen, EP App. No. 1,465,234 to Bruker Daltonics, and Julian et al., "Ion Funnels for the Masses: Experiments and Simulations with a Simplified Ion Funnel", J. Amer. Soc. Mass Spec., vol. 16, pp. 1708-1712 (2005).

Additional background information on stacked ring electrode structures can be found in U.S. Pat. No. 6,417,511 B1, entitled "Ring Pole ion Guide Apparatus, Systems and Method," to Russ, I V et al., issued Jul. 9, 2002, including the following: "The present invention provides a novel ion transport apparatus and method that can be used in mass spectrometry. The ion transport apparatus and method comprise a ring stack that extends inside a multipole. The apparatus and method achieve the focusing and confinement advantages of a conventional RF multipole and the advantage of an axial field of a conventional stacked ring guide or ion funnel . . . ."

Further background information on similar but different configurations that utilize stacked electrode structures can also be found in co-pending U.S. patent application Ser. No. 12/125,013, entitled Ion Transport Device And Modes Of Operation Thereof," filed May 21, 2008, to Senko et al, the disclosure of which is incorporated by reference in its entirety. Such an application includes the following description: "an ion transport device is provided consisting of a plurality of apertured electrodes which are spaced apart along the longitudinal axis of the device. The electrode apertures define an ion channel along which ions are transported between an entrance and an exit of the device. An oscillatory (e.g., RF) voltage source, coupled to the electrodes, supplies oscillatory voltages in an appropriate phase relationship to the electrodes to radially confine the ions. In order to provide focusing of ions to the centerline of the ion channel near the device exit, the spacing between adjacent electrodes increases in the direction of ion travel. The relatively greater inter-electrode spacing near the device exit provides for proportionally increased oscillatory field penetration, thereby creating a tapered field that concentrates ions to the longitudinal centerline. The magnitudes of the oscillatory voltages may be temporally varied in a scanned or stepped manner in order to optimize transmission of certain ion species or to reduce mass discrimination effects. A longitudinal DC field, which assists in propelling ions along the ion channel, may be created by applying a set of DC voltages to the electrodes."

While such structures in the above mentioned background disclosures have their benefits, there is still a need to minimize positioning and deleterious field effects produced by such stacked ring structures when coupled to ion transfer tubes (e.g., a narrow-bore capillary tube) as known and understood by those skilled in the art. The present invention addresses such a need.

SUMMARY OF THE INVENTION

The present invention is directed to a device, method and system for improved transportation and focusing of ions in a low vacuum or atmospheric-pressure region of a mass spectrometer including the novel coupling of one or more electro-dynamic or one or more electro-static focusing lenses to the first electrode of a stacked ring ion guide (SRIG) to which oscillatory (e.g., radio-frequency) voltages are applied. Specifically and in accordance with an aspect of the present invention, an ion transport device is disclosed that includes electro-dynamic or electro-static focusing lenses coupled to a stacked electrode structure, which collectively define an ion channel along which ions may be directed. Such an arrangement is also beneficially coupled to an ion transfer device, e.g., a capillary tube, having an outlet end configured so that the outlet end is capable of being positioned between a flush position with the front surface of the first of the disclosed one or more electro-dynamic or electrostatic focusing lenses and before the back surface of a desired disclosed one or more electro-dynamic or electro-static focusing lenses or moveably positioned before the front surface of the first of one or more configured electrostatic focusing lenses.

In one particular configuration, along with other beneficial arrangements as disclosed herein, an oscillatory voltage is applied to at least a portion of the one or more electro-dynamic lenses and the plurality of electrodes to result in the minimization of deleterious field effects and/or repositioning problems of the disclosed ion transfer instruments of the present invention so as to direct the transportation and focusing of ions of various charges along a desired ion channel path. As another particular configuration, by having an applied DC voltage to one or more lenses of the present invention results in an electro-static configuration so as to also result in the direction/transportation and focusing of ions of various charges along a desired ion channel path.

In accordance with another aspect of the present invention, a mass spectrometer system is disclosed that includes the novel coupling of one or more electro-dynamic or electro-static focusing lenses to the first electrode of a stacked ring ion guide (SRIG) to which oscillatory (e.g., radio-frequency) voltages are applied.

In accordance with another aspect of the present invention, a method for transporting and focusing ions within a low vacuum or atmospheric pressure region of a mass spectrometer is disclosed that includes: providing one or more electro-dynamic focusing lenses electrically coupled to a first electrode that comprises a plurality of longitudinally spaced apart electrodes that in combination with the one or more electro-dynamic focusing lenses, define an ion channel along which ions may be directed; positioning an outlet end of an ion transfer device between a flush position with the front surface of the first of the one or more electro-dynamic focusing lenses and before the back surface of a desired one or more electro-dynamic focusing lenses; and applying oscillatory voltages to the one or more electro-dynamic focusing lenses and the plurality of longitudinally spaced apart electrodes to generate an electric field that radially confines ions within the ion channel; and increasing the radial electric field penetration in the direction of ion travel.

As a final aspect of the present invention, a method for transporting and focusing ions within a low vacuum or atmospheric pressure region of a mass spectrometer is disclosed that includes: providing one or more electro-static lenses electrically coupled to a first electrode that comprises a plurality of longitudinally spaced apart electrodes that in combination with the one or more electrostatic focusing lenses, define an ion channel along which ions may be directed; positioning an outlet end of an ion transfer device between a flush position with the front surface of the first of the one or more electro-static focusing lenses and before the back surface of a desired one or more electro-static focusing lenses; applying RF oscillatory voltages to the plurality of longitudinally spaced apart electrodes; applying a DC voltage to the one or more electro-static focusing lenses having a fixed DC voltage that is related to the peak RF amplitude applied to a first lens of the plurality of longitudinally spaced apart electrodes and thus generate an electric field that radially confines ions within the ion channel; and increasing the radial electric field penetration in the direction of ion travel.

In any arrangement, deleterious field effects and/or repositioning problems of the disclosed ion transfer instruments of the present invention are minimized by the coupling methods/apparatus, and systems of the present invention. In addition, streaming of clusters, neutrals and undesolvated droplets to the downstream, lower-pressure regions of the mass spectrometer are also reduced by for example laterally and/or angularly offsetting the ion transfer device with respect to the ion transport device entrance and laterally offsetting electrode apertures relative to apertures of adjacent electrodes to block a line-of-sight path.

DETAILED DESCRIPTION OF EMBODIMENTS

Figure 1:
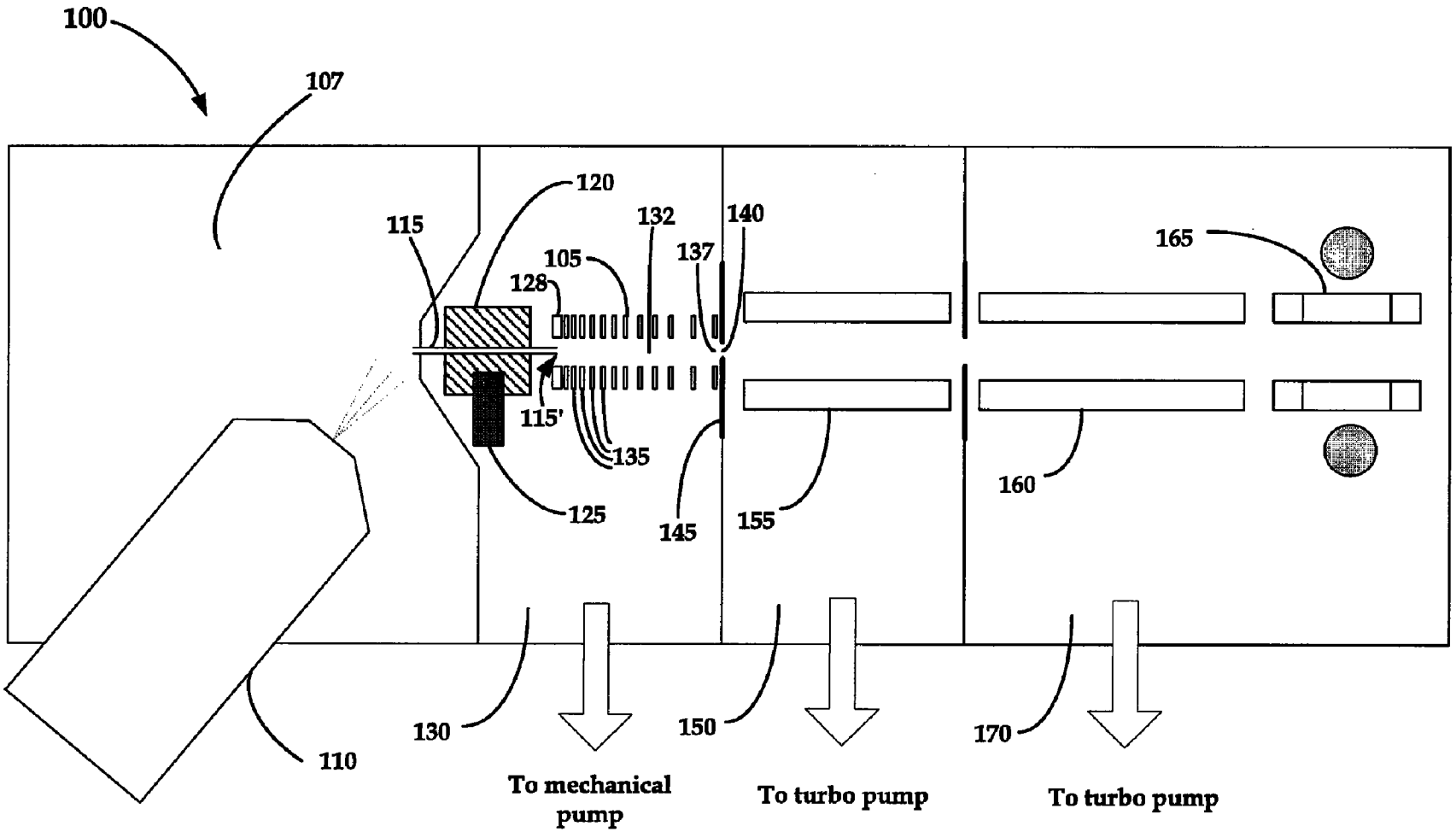
FIG. 1 is a schematic depiction of a mass spectrometer incorporating an ion transfer tube/ion transport device constructed in accordance with an example embodiment of the present invention.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Additionally, it will be understood that any list of such candidates or alternatives is merely illustrative, not limiting, unless implicitly or explicitly understood or stated otherwise.

Moreover, unless otherwise indicated, numbers expressing quantities of ingredients, constituents, reaction conditions and so forth used in the specification and claims are to be understood as being modified by the term "about." Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

General Description

The present invention addresses deleterious field effects and/or repositioning problems of desired instruments that utilize stacked ring ion guides by generally positioning the outlet end of an ion transfer device (e.g., a narrow-bore capillary tube) to be at least flush with the front surface and before the back surface of the electro-dynamic or electro-static focusing lens or collective focusing lens of the present invention. It is to be appreciated that similar configurations, as found in co-pending U.S. patent application Ser. No. 12/125,013, entitled Ion Transport Device And Modes Of Operation Thereof," are to be incorporated by reference herein in its entirety with any conflicts in embodiments controlled by the present disclosure.

As a beneficial configuration, the electro-static but more particularly, the electro-dynamic radio frequency (RF) focusing lens disclosed herein (e.g., an electro-dynamic tube-like lens) is often configured to operate in a similar fashion as the first electrode of a SRIG. Such a lens in having similar lateral dimensions of about 25 mm by about 25 mm and a similar aperture range (i.e., having a circular diameter aperture from about 7.0 mm up to about 15 mm), but differing in thickness from the rest of the electrode stack via a thickness range from about 0.6 mm up to about 8.0 mm, enables the outlet end of an ion transfer device (tube) to be confidently positioned therebetween the front and end surface planes of the electro-dynamic focusing lens operating as the first electrode of a SRIG of the present invention. Thus, the physical thickness itself provides for larger ion focusing lens tolerances when coupled to an ion transfer tube.

As another beneficial arrangement of the present invention, a series of two or more electrodes each having lateral dimensions of about 25 mm by about 25 mm, a collective length of up to about 8.0 mm, and all configured with a regular thickness of, for example, between about 0.5 mm up to about 1.0 mm, can also be utilized so that the outlet end of an ion transfer device (tube) can be positioned therebetween predetermined surfaces, which also beneficially enables larger ion focusing lens tolerances and thus minimizes positioning problems and the harmful field effects, as discussed herein.

With respect to a single electro-dynamic or electro-static focusing lens embodiment, an RF can be applied to such lenses in a variety of novel configurations. For example, an RF can be applied equal or unequal in amplitude and equal or unequal in frequency (e.g., double the frequency) and either in-phase or out of phase with respect to the first electrode of the SRIG (i.e., depending upon whether the first encountered electrode is predetermined to be in or out of phase with the len(es) of the present invention). As another beneficial configuration, the focusing lens (i.e., the electro-static lens) can have an applied fixed DC voltage that is related (including opposite) to the peak RF amplitude (which could be ramped with e.g., mass) applied to the first lens encountered along the longitudinal direction of the SRIG.

With regards to the series of lenses embodiment, the lenses themselves are in one arrangement, all of regular thickness that collectively operate as an electro-dynamic focusing lens, with an applied RF to the series equal in amplitude and having a same applied frequency and phase of RF (via a physical coupling) but either out of phase (e.g., 180 degrees) or in-phase with respect to the first electrode of the SRIG and having a same or different amplitude and a same or different frequency (e.g., twice the frequency) as the first electrode of the SRIG encountered along the longitudinal direction. As another example arrangement, the series of lenses themselves are all of regular thickness that collectively operate as an electro-dynamic focusing lens slightly in contact (via, for example, capacitive coupling) with an applied RF to the series having equal amplitude and frequency and all in the series having the same phase but wherein the series of lenses are either out of phase or in-phase with respect to the first electrode of the SRIG and having a same or different amplitude and a same or different frequency (e.g., twice the frequency) as the first electrode of the SRIG encountered along the longitudinal direction. In addition, much like the single lens embodiment, the series of lenses can have an applied fixed DC voltage (via fixed coupling) that is related (including opposite) to the peak RF amplitude (which could be ramped with e.g., mass) applied to the first lens encountered along the longitudinal direction of the SRIG. Thus, such an arrangement also provides for the guiding of ions that is similarly achieved with the electro-dynamic series of lens embodiment.

Specific Description

FIG. 1 shows a schematic example configuration of a mass spectrometer 100, which incorporates the novel electro-dynamic or electro-static focusing lens 128/ion transport device 105 coupling, as constructed in accordance with embodiments of the present invention. As known by those skilled in the art, analyte ions may be formed by electrospraying a sample solution into an ionization chamber 107 via an electrospray probe 110. For an ion source that utilizes the electrospray technique, ionization chamber 107 can generally be maintained at or near atmospheric pressure. The analyte ions, together with background gas and partially desolvated droplets, flow into the inlet end of, for example, a conventional ion transfer tube 115 (a narrow-bore capillary tube) and traverse the length of the tube under the influence of a pressure gradient. In order to increase ion throughput from ionization chamber 107, multiple capillary tubes (or an ion transfer tube with multiple channels) may be substituted for the single channel ion transfer tube depicted herein. Analyte ion transfer tube 115 is preferably held in good thermal contact with a block 120 that is heated by cartridge heater 125. As is also known in the art, heating of the ion/gas stream passing through ion transfer tube 115 assists in the evaporation of residual solvent and increases the number of analyte ions available for measurement. As configured within low vacuum chamber 130, the analyte ions (not shown) emerge from ion transfer tube 115 via an outlet end 115' arranged in a novel way to open therebetween a predetermined region of a single or a plurality of electro-dynamic focusing lens(es) 128, which can have an applied DC but are preferably RF coupled with a first electrode that makes up the ion transport device 105 of the present invention.

In particular, and as disclosed above, with respect to a single electro-dynamic focusing lens embodiment, the RF can be applied having an equal or different amplitude and having a same or different frequency (e.g., double the frequency) with respect to the first electrode of the SRIG encountered along the longitudinal direction. It is also to be appreciated that the single electro-dynamic focusing lens embodiment is additionally capable of being configured to be either in-phase or out of phase, e.g., 180 degrees, with respect to the aforementioned first electrode of the SRIG encountered along the longitudinal direction. As another beneficial configuration, the focusing lens (i.e., the electro-static lens) can have an applied fixed DC voltage that is related (including opposite) to the peak RF amplitude (which could be ramped with e.g., mass) applied to the first lens encountered along the longitudinal direction of the SRIG.

Also as discussed above, with respect to the series of lenses embodiment, the lenses themselves are in one arrangement, all of regular thickness with an applied RF to the series equal in amplitude and frequency and having the same phase of the RF (via a physical coupling) but having a same or different amplitude with a same or different applied frequency (e.g., double the frequency) and a same or out of phase relationship with respect to the first electrode of the SRIG. As another example, the series of lenses themselves can be configured slightly in contact (via, for example, capacitive coupling) with an applied RF to the series equal in amplitude and frequency and having the same phase of the RF, but with respect to the first electrode of the SRIG encountered along the longitudinal direction, the series of lenses are configured with a same or different applied amplitude and a same or different applied frequency (e.g., double the frequency) and a same phase or out of phase relationship with respect to the first electrode of the SRIG. In addition, much like the single lens embodiment, the series of lenses can have an applied fixed DC voltage (via fixed coupling) that is related (including opposite) to the peak RF amplitude (which could be ramped with e.g., mass) applied to the first lens encountered along the longitudinal direction of the SRIG.

To achieve the low vacuum within chamber 130, a mechanical pump or equivalent is coupled to chamber 130, as denoted by the accompanying directional arrow, so as to enable a pressure in the range from about 1 Torr up to about 10 Torr (approximately 1-10 millibar) with the capability of also being successfully operated over a broad range of low vacuum and atmospheric pressures of between about 0.1 millibar up to about 1 bar.

It is also to be appreciated that the electro-spray ionization source, depicted and described herein, is presented by way of an illustrative example, and that the ion transport device 105, which includes the electro-dynamic or electro-static focusing lens 128 of the present invention should not be construed as being limited to use with an electro-spray or other specific type of ionization source. Other ionization techniques that may be substituted for (or used in addition to) the electro-spray source, as shown herein, include, but is not strictly limited to, chemical ionization, photo-ionization, and laser desorption or matrix-assisted laser desorption/ionization (MALDI).

The analyte ions exit the outlet end of ion transfer tube 115 as a free jet expansion and travel through an ion channel 132 defined within the interior of the electro-dynamic or electro-static focusing lens 128/ion transport device 105. As to be discussed in further detail below, radial confinement and focusing of ions within ion channel 132 are achieved by application of either a DC voltage that is related (including opposite) to the peak RF amplitude (which could be ramped with e.g., mass) applied apertured electrodes 135 or by oscillatory voltages to the electro-dynamic focusing lens 128 and the apertured electrodes 135 of the ion transport device 105. As is further discussed below, transport of ions along ion channel 132 to device exit 137 may be facilitated by generating a longitudinal DC field and/or by tailoring the flow of the background gas in which the ions are entrained. Ions leave ion transport device 105 as a narrowly focused beam and are directed through aperture 140 of extraction lens 145 into chamber 150. The directed ions then pass through ion guides 155 and 160 and are delivered to a mass analyzer 165, e.g., a multipole device, which, as generally depicted in FIG. 1, may take the form of a conventional two-dimensional quadrupole ion trap located within chamber 170. Chambers 150 and 170 may be evacuated to relatively low pressures by means of connection to ports of a turbo pump, as denoted by the accompanying arrows.

Figure 2B:
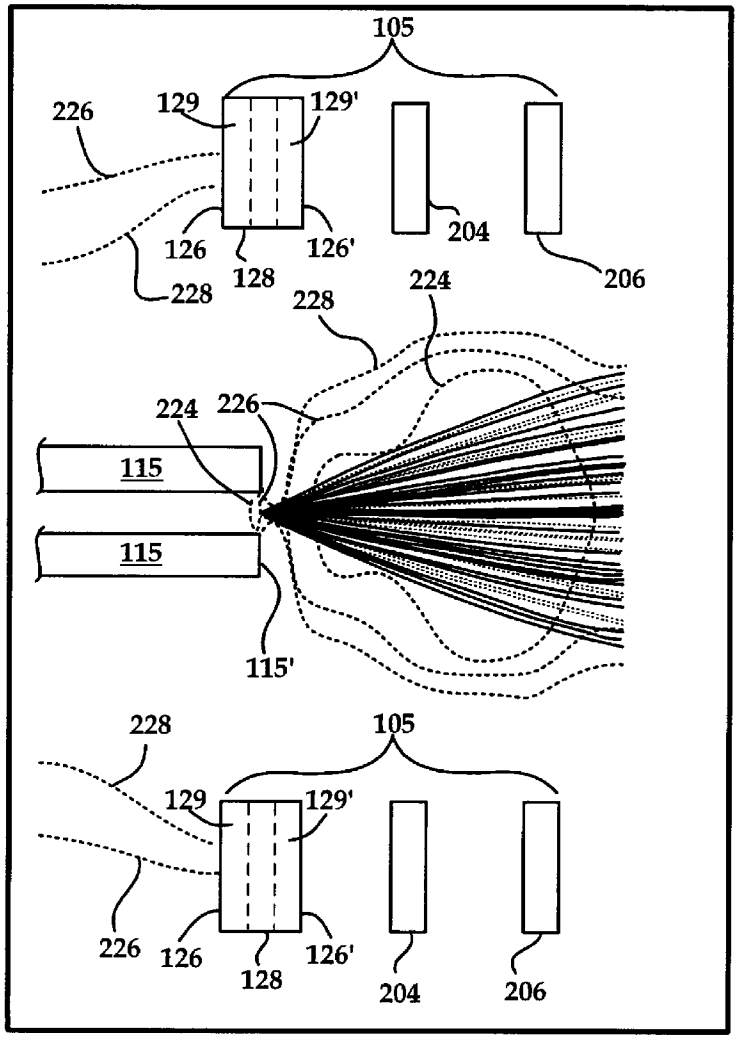
FIG. 2B shows an example cross-sectional view of a novel ion transfer tube/ion transport device arrangement of the present invention, wherein the outlet end of the ion transfer tube is now positioned therebetween the front and the back surface of a thicker first electrode of an SRIG.
Figure 2A:
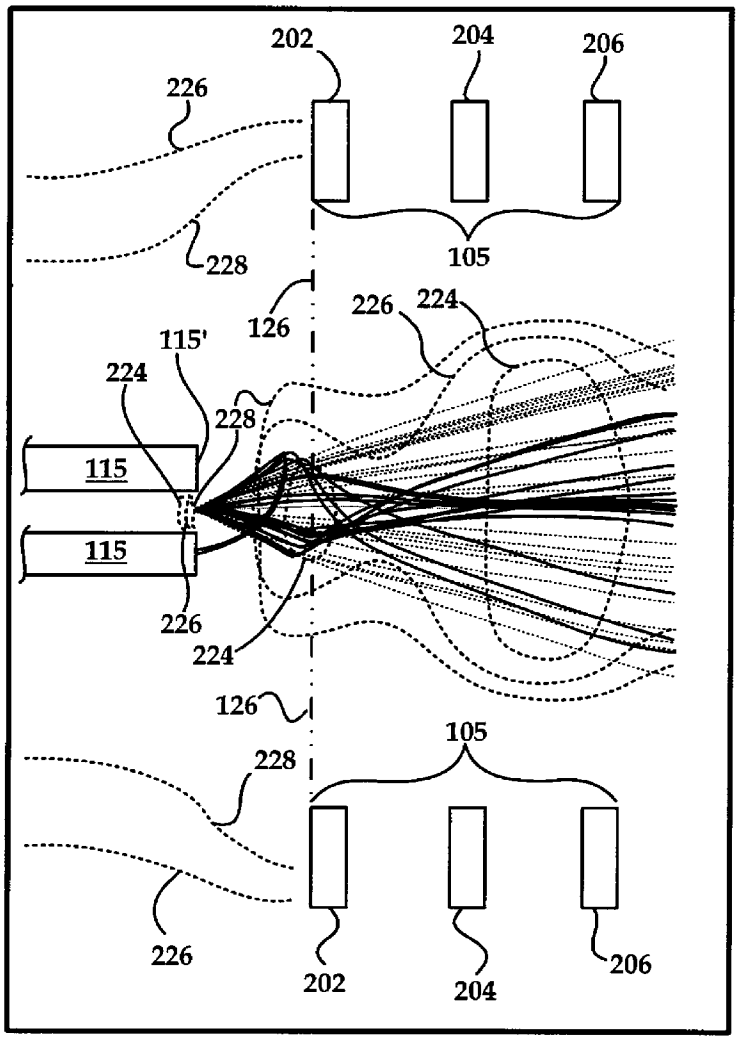
FIG. 2A shows an example cross-sectional view of an ion transfer tube/stacked ring ion guide (SRIG) arrangement, wherein the outlet end of the ion transfer tube ends before the first surface of the first electrode of the SRIG.

FIG. 2A shows an example cross-sectional view of an ion transfer device 115/ion transport device 105 (e.g., a stacked ring ion guide (SRIG)) arrangement as similarly discussed in incorporated by reference U.S. patent application Ser. No. 12/125,013). Such a configuration includes the outlet end 115' of the ion transfer tube 115 device ending before a plane defined by a first surface 126 (denoted by a dashed and dotted line) of a first electrode 202 that can comprise the ion transport device 105, e.g., a stacked ring ion guide (SRIG). For clarity, only the first three electrodes 202, 204, and 206 of the stacked ring ion guide (SRIG) 105 are shown in FIG. 2A. Field gradients are shown by the thickened dashed lines with 0.5 V/mm denoted by the reference numeral 224 (note the two separate oblong-like field gradients), 1.0 V/mm denoted by reference numeral 226, and 1.5 V/mm denoted by the reference numeral 228. Interleaving potentials are often applied to such configured electrodes, in this example, a potential of +10 V is applied to first 202 and third 206 electrodes, −10 V to second electrode 204 of the SRIG 105, while the ion transfer tube 115 is maintained at ground potential. From such a configuration, ion trajectories can be simulated, as shown in FIG. 2A, with about thirty ion trajectories simulated for singly charged ions having a mass of about 748 Daltons (shown as thin dashed lines directed from left to right in FIG. 2A) while about thirty ion trajectories are shown simulated for doubly charged ions of the same mass (shown as solid lines directed from left to right in FIG. 2A). All the ions in producing such trajectories have a small energy of about 0.25 electron-volts with the initial velocity vectors stepped in equal steps between about −22 and 22 degrees with respect to the horizontal axis.

FIG. 2B shows an example cross-sectional view of a novel ion transfer device 115/ion transport device 105 arrangement of the present invention utilizing an electro-dynamic lens. In particular, outlet end 115' of the ion transfer device 115 device is now positioned therebetween a front surface 126 and a back surface 126' of, for example, a SRIG configured with a thicker first electrode, e.g., an electro-dynamic focusing lens (electrode) 128, having a thickness from about 0.6 mm up to about 8.0 mm. Again for clarity, only an electro-dynamic focusing lens 128, having an applied field of about +10 V, as well as two additional example electrodes 204, having an applied field of about −10 V, and 206, having an applied field of about +10 V, of a stacked ring ion guide (SRIG) 105, are shown in FIG. 2B. Also as before, field gradients are shown by the thickened dashed lines with 0.5 V/mm denoted by the reference numeral 224, 1.0 V/mm denoted by reference numeral 226, and 1.5 V/mm denoted by the reference numeral 228.

Comparing FIGS. 2A and 2B clearly shows that the area where the field is less than 0.5 V/mm (within the gradient contour denoted by the reference numeral 224) is larger in FIG. 2B, which indicates that fringing fields in such a configuration are reduced. Since the electric force on an ion is proportional to its charge, multiply charged ions experience the strongest forces due to the field effects evidenced in FIG. 2A than that as shown in FIG. 2B and therefore such multiply charged ions are more subject to losses than singly charged ions in a conventional arrangement before they are confined toward the central axis of a SRIG. The benefits of the present invention are thus seen in the simulated trajectories of FIG. 2B as the trajectories of singly (solid darkened lines) and doubly (thin dashed lines) are substantially similar; whereas there is a clear difference in FIG. 2A between the two sets of trajectories.

It is also to be appreciated that while the configuration, as shown in FIG. 2B, is a beneficial embodiment, the thickened electrode 128 of FIG. 2B (e.g., the electro-dynamic focusing lens of the present invention) can also be reconfigured as a series of two or more electro-dynamic lenses 129, 129' (as denoted by dashed lines within the example lens 128 of FIG. 2B). Such an example embodiment also enables larger electro-dynamic focusing lens tolerances, which minimizes positioning problems when coupled to an ion transfer device 115 and thus harmful field effects. Specifically, such a series of two or more lenses can be configured with a regular thickness of, for example, thicknesses from about 0.5 mm up to about 1 mm, to enable comfortable positioning of the outlet end 115' of the ion transfer device 115 while also providing for the reduced fringing fields, as shown in FIG. 2B.

Figure 3A:
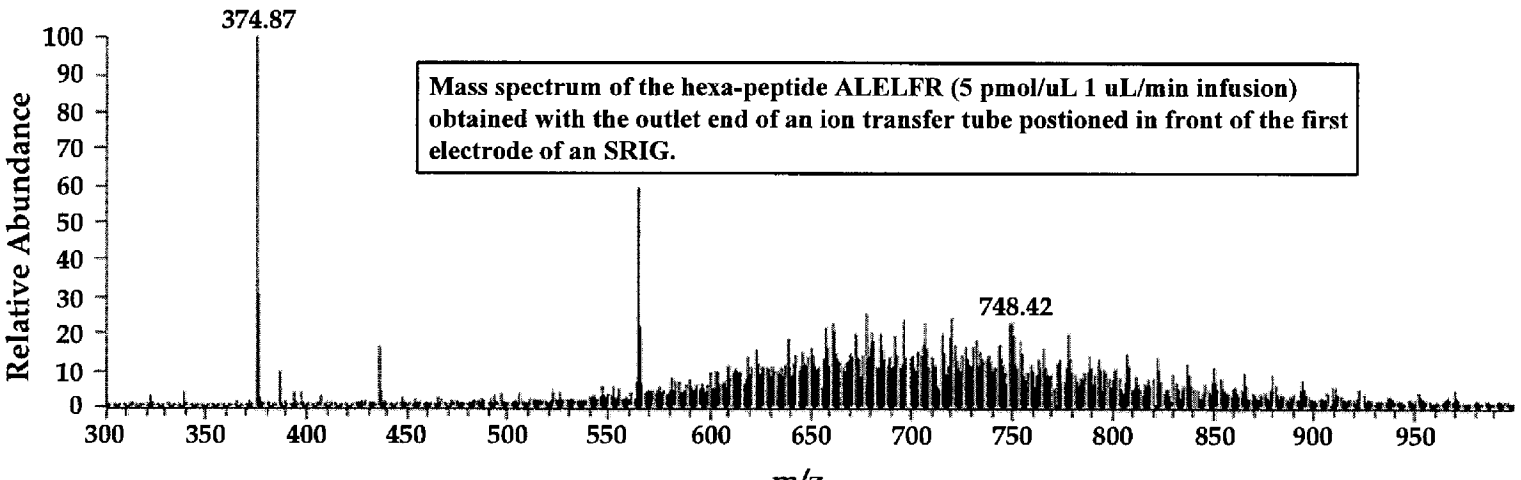
FIG. 3A shows an example mass spectrum of the hexa-peptide ALELFR obtained with the outlet end of the ion transfer tube ending before the first surface of the first electrode of the SRIG.
Figure 3B:
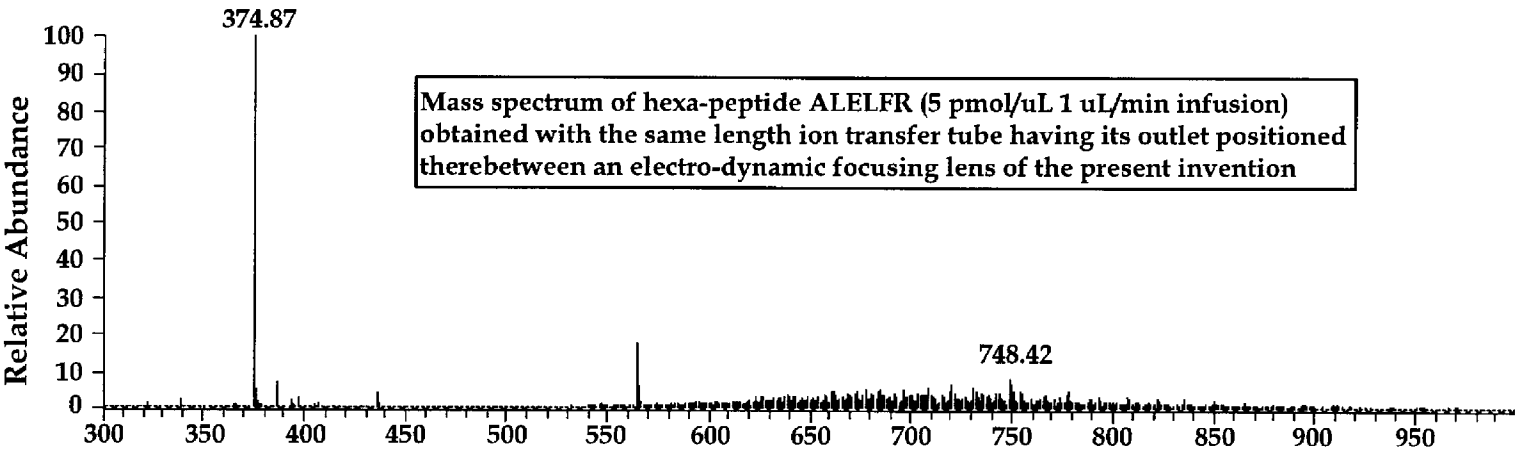
FIG. 3B shows a mass spectrum of the same hexa-peptide ALELFR now obtained with an ion transfer tube/electro-dynamic or electro-static focusing lens/SRIG configuration of the present invention.

FIG. 3A shows an example mass spectrum of the hexa-peptide ALELFR obtained with the ion transfer tube/SRIG configuration of FIG. 2A, i.e., without the use of an electro-dynamic focusing lens configuration of the present invention. Conversely, FIG. 3B shows a mass spectrum of the same hexa-peptide ALELFR now obtained with an ion transfer tube/electro-dynamic focusing lens/SRIG of the present invention, as generally shown in FIG. 2B. From a comparison of FIGS. 3A and 3B, it can be seen that the use of the RF-electro-dynamic focusing lens reduces the loss of the doubly charged ions of ALELFR (m/z 374.87). The loss of doubly charged ions is more pronounced as the RF amplitude applied to the SRIG is increased. In this experimental example to illustrate the principles herein, the RF amplitude applied to the first electrode of the SRIG is the same as that applied to the electro-dynamic focusing lens, 148 V(p-p) at 680 kHz, with a 180 phase difference (i.e., an out of phase example arrangement) between the RF-electro-dynamic focusing lens and the first electrode of the SRIG encountered along the longitudinal direction. While an RF in the example of FIG. 3B can be applied to the single electro-dynamic focusing lens embodiment equal in amplitude and frequency but out of phase with respect to the first electrode of the SRIG, it is to be reemphasized, as stated above, that the present invention is not to be construed as limited to such single lens, same frequency, same amplitude, or even an RF arrangement. Moreover, the present invention can also comprise a series of lenses embodiment that collectively can operate as an electrostatic focusing lens, wherein the lenses often all of regular thickness, can have an applied fixed DC voltage (via physical coupling) that is related (including opposite) to the peak RF amplitude (which could be ramped with e.g., mass) applied to the first lens encountered along the longitudinal direction of the SRIG.

More often however, the series of lenses can have an applied RF to the series equal in amplitude and frequency and phase (via a physical coupling) but having a same phase or out of phase RF relationship, e.g., 180 degrees, with respect to the first electrode encountered along the longitudinal direction of the SRIG. In addition and as another example arrangement, the series of lenses embodiment can be slightly in contact (via, for example, capacitive coupling) to enable an applied RF having equal amplitude, phase, and the same frequency but wherein the series comprises a same phase or out of phase relationship and a same or different frequency and a same or different amplitude as the first electrode encountered along the longitudinal direction of the SRIG.

As similarly discussed in co-pending and incorporated by reference U.S. patent application Ser. No. 12/125,013, entitled Ion Transport Device And Modes Of Operation Thereof," the ion transport device 105, as generally shown in FIG. 2A and FIG. 2B, is formed from a plurality of generally planar electrodes arranged in longitudinally spaced-apart relation (regular or irregular spacing) and are often referred to in the mass spectrometry art as "stacked-ring" ion guides. Each electrode, e.g., 204, as shown in FIG. 2A, is adapted with an aperture through which ions may pass. The apertures collectively define an ion channel, which may be straight or curved, depending on the lateral alignment of the apertures. All of the electrodes may have identically sized apertures and/or uniquely sized apertures. An oscillatory (e.g., radio-frequency) voltage source is often utilized to apply oscillatory voltages to such electrodes so as to generate a field that radially confines ions within a designed ion channel. The electrodes that make up the SRIG may be divided into a configuration wherein a predetermined plurality of electrodes are interleaved with a plurality of other configured electrodes so that respective electrodes receive an oscillatory voltage that is opposite in phase with respect to the oscillatory voltage applied to adjacent electrodes. In a beneficial arrangement, the frequency and amplitude of the applied oscillatory voltages are from about 0.5 MHz up to about 1 MHz and from about 50 up to about 400 Vp-p (peak-to-peak), the required amplitude being strongly dependent on frequency. Moreover, the present invention can be configured with an increased inter-electrode spacing near the SRIG device exit, as similarly described in incorporated by reference U.S. patent application Ser. No. 12/125,013 and thus can utilize fewer electrodes relative to conventional ion funnel devices as known and described in the art. Importantly, the above described structure creates a tapered electric field that focuses the ions to a narrow beam proximate the SRIG device exit. As an additional configuration, the electrode spacing can gradually and continually increase in the direction of ion travel along the full length of an ion transport device 105, as generally shown in FIG. 2A. In other implementations, electrode spacing may be regular along one or more segments of the ion transport device length (e.g., proximate to the device entrance), and then increase along another segment (e.g., proximate to the device exit). Furthermore, certain implementations may utilize a design in which the electrode spacing increases in a stepped rather than gradual manner.

The electrodes of the electro-static or electro-dynamic focusing lens or series of lenses may comprise a square plate that is partially or wholly fabricated from an electrically conductive material, such as stainless steel or brass. In an alternative configuration, the electrode structure may be formed by depositing (to an appropriate thickness and over a suitable area) a conductive material on the central region (i.e., the region radially adjacent to the aperture) of an insulative substrate, such as that used for printed circuit boards. A set of conductive traces may also be deposited between the central region and the edge of the plate to establish electrical connections to the oscillatory and/or DC voltage sources.

To prevent pseudo-potential barriers from stalling ions, a longitudinal DC field may be created via a coupled DC voltage source, as discussed in incorporated by reference U.S. patent application Ser. No. 12/125,013, that applies a set of DC voltages to electrodes, e.g. electrodes 204, 206, as shown in FIG. 2B. The applied voltages increase or decrease in the direction of ion travel, depending on the polarity of the transported ions. Such a longitudinal DC field assists in propelling ions toward a desired direction and ensures that undesired trapping does not occur. Under typical operating conditions, a longitudinal DC field gradient of 1-2 V/mm is sufficient to eliminate stalling of ions within an ion transfer device of the present invention. In alternate embodiments, a longitudinal DC field may be generated by applying suitable DC voltages to auxiliary electrodes (not shown) e.g., a set of resistivelycoated rod electrodes positioned outside the ring electrodes rather than to ring electrodes, e.g. electrodes 204, 206, as shown in FIG. 2B.

To generate a tapered radial field that promotes a high ion acceptance efficiency at the exit of the electrodes structure that makes up the ion transport device (e.g., 105, as shown in FIG. 2B), the amplitude of oscillatory voltages applied to predetermined electrodes increases in the direction of ion travel, such that each electrode, e.g., 204, 206, as shown in FIG. 2B, receives an oscillatory voltage of greater amplitude relative to electrodes in the upstream direction. The desired oscillatory voltages may be delivered through a set of attenuator circuits (not shown) coupled to an oscillatory voltage source (not shown). As an example configuration, the oscillatory voltage has a frequency of about 0.5 MHz up to about 1 MHz and an amplitude that varies from about 50 up to about 100 Vp-p at the device entrance, e.g., at the entrance to the electro-dynamic focusing lens 128, as shown in FIG. 2B, to 400-600 V (p-p) at the device exit 137, as shown in FIG. 1. The required maximum amplitude of the applied oscillatory voltage is dependent on the inter-electrode spacing, and may be reduced by utilizing a wider spacing (e.g., spacing on 4 mm centers may reduce the maximum applied voltage to 100 Vp-p).

It should also be recognized that the techniques for generating a tapered radial field embodied via a SRIG may include one or both of longitudinally increasing electrode spacing or longitudinally increasing oscillatory voltage amplitude to create the tapered field.

In addition, the ion transport devices 105, as generally shown in FIG. 2B, often can be configured with straight ion channels. However, it may also be beneficial to arrange the electrodes so as to define a curved ion channel, such as, but not limited to an S-shaped ion channel or an arcuate ion channel, as similarly discussed in incorporated by reference U.S. patent application Ser. No. 12/125,013. Such an arrangement reduces the streaming of neutral gas molecules, clusters and undesolvated droplets into the lower-pressure regions of the mass spectrometer, thereby improving signal-to-noise ratios and reducing pumping requirements.

Also as similarly discussed in incorporated by reference U.S. patent application Ser. No. 12/125,013, the ions can be introduced via the ion transfer tube 115, as shown in FIG. 1, in a configuration wherein the outlet end 115' is laterally and/or angularly (typically up to about 5°) offset with respect to the center of the electro-dynamic or electro-static focusing lens(es) 128, as disclosed herein, but positioned to be at least flush with the front surface and before the back surface of the electro-dynamic or electrostatic focusing lens or collective lens of the present invention so as to also reduce streaming of neutral gas molecules, clusters and undesolvated droplets into the lower-pressure regions of the mass spectrometer. It is to be appreciated, however, that the present invention provides a beneficial aspect for such an arrangement by constraining the directed ions to the center of the ion channel, as discussed above in describing the aspects of FIG. 2B, to prevent unintended fragmentation of labile analyte molecules from coming close to the electrodes and thus being exposed to regions of relatively high RF field strength.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An ion transport device, comprising:

one or more electro-dynamic or electro-static focusing lenses electrically coupled to a first electrode that comprises a plurality of longitudinally spaced apart electrodes that in combination with said one or more electro-dynamic focusing or electro-static lenses, define an ion channel along which ions may be directed;

an ion transfer device having an outlet end configured so that said outlet end is moveably positioned between a flush position with the front surface of the first of said one or more electro-dynamic or electro-static focusing lenses and before the back surface of a desired said one or more electro-dynamic or electro-static focusing lenses; and an oscillatory voltage source configured to apply oscillatory voltages to at least a portion of said one or more electro-dynamic lenses and said plurality of electrodes or a DC voltage source configured to apply a DC voltage to at least a portion of said one or more electro-static lenses, said one or more electro-static lenses being coupled to said plurality of electrodes having applied oscillatory voltages;

wherein at least one of (i) the spacing between adjacent electrodes, and (ii) the amplitude of the applied oscillatory voltages of said plurality of electrodes increases in the direction of ion travel.

2. The ion transport device of claim 1, wherein an RF is applied to said one or more electro-dynamic focusing lenses equal in amplitude and frequency but out of phase with respect to the first electrode of said plurality of longitudinally spaced apart electrodes.

3. The ion transport device of claim 1, wherein an RF is applied to said one or more electro-dynamic focusing lenses equal in amplitude and frequency but in-phase with respect to the first electrode of said plurality of longitudinally spaced apart electrodes.

4. The ion transport device of claim 1, wherein a frequency applied to said first electrode of said plurality of longitudinally spaced apart electrodes is of a different frequency applied to said one or more electro-dynamic focusing lenses.

5. The ion transport device of claim 4, wherein said different frequency is twice the frequency.

6. The ion transport device of claim 1, wherein a DC is applied to said one or more electro-static lenses having a fixed DC voltage that is related to the peak RF amplitude applied to said first lens of said plurality of longitudinally spaced apart electrodes encountered along the longitudinal direction.

7. The ion transport device of claim 6, wherein said outlet end of said ion transfer device is moveably positioned before the front surface of the first of said one or more electro-static focusing lenses.

8. The ion transport device of claim 1, wherein said one or more electro-dynamic focusing lenses comprises a plurality of electro-dynamic focusing lenses having a same phase relationship.

9. The ion transport device of claim 8, wherein said same phase relationship is provided by a physical coupling.

10. The ion transport device of claim 8, wherein said same phase relationship is provided by a capacitive coupling.

11. The ion transport device of claim 1, wherein said one or more electro-dynamic focusing lenses or said one or more electro-static lenses comprises a single electro-dynamic or electro-static focusing lens having a thickness from about 0.6 mm up to about 8.0 mm.

12. The ion transport device of claim 1 wherein each of said one or more electro-dynamic or electro-static focusing lenses comprises a thickness from about 0.5 mm up to about 1.0 mm with said one or more electro-dynamic lenses or one or more electro-static lenses providing a collective length of up to about 8 mm.

13. The ion transport device of claim 1, wherein said ion transfer device comprises a lateral and/or angular offset with respect to the center of said one or more electro-dynamic or electro-static focusing lenses.

14. The ion transport device of claim 1, wherein the oscillatory voltage source is a radio-frequency (RF) voltage source.

15. The ion transport device of claim 1, wherein the amplitude of the applied oscillatory voltages to said plurality of longitudinally spaced apart electrodes increases in the direction of travel.

16. The ion transport device of claim 1, wherein said plurality of longitudinally spaced apart electrodes comprises a first set of electrodes arranged in an interleaved relation with a plurality of a second set electrodes, wherein the oscillatory voltage applied to said first set of electrodes is opposite in phase to the oscillatory voltage applied to said second set of electrodes.

17. The transport device of claim 1, wherein the apertures of said one or more electro-dynamic or electro-static focusing lenses and said plurality of longitudinally spaced apart electrodes define at least one ion channel selected from: a substantially straight ion channel, an S-shaped ion channel, and an arcuate ion channel.

18. The ion transport device of claim 1, wherein the spacing between adjacent electrodes of said plurality of longitudinally spaced apart electrodes increases in the direction of ion travel.

19. The ion transport device of claim 1, wherein said ion transfer device comprises at least one elongated capillary for carrying ions from the ion source.

20. The ion transport device of claim 1, wherein said ion transfer device comprises at least one elongated capillary for carrying ions from the ion source having an outlet end adapted to a position before said one or more electro-static lenses.

21. The ion transport device of claim 19, wherein said at least one elongated capillary comprises multiple ion flow channels.

22. The ion transport device of claim 19, wherein said at least one elongated capillary defines at an outlet end, a flow axis being angled and/or laterally offset with respect to the central longitudinal axis of said ion transport device.

23. A mass spectrometer, comprising:

an ion source;

a mass analyzer; and an ion transport device located intermediate in an ion path between the ion source and the mass analyzer, the ion transport device further comprising:

one or more electro-dynamic or electro-static focusing lenses electrically coupled to a first electrode that comprises a plurality of longitudinally spaced apart electrodes that in combination with said one or more electro-dynamic focusing or electro-static lenses, define an ion channel along which ions may be directed;

an ion transfer device having an outlet end configured so that said outlet end is moveably positioned between a flush position with the front surface of the first of said one or more electro-dynamic or electro-static focusing lenses and before the back surface of a desired said one or more electro-dynamic or electro-static focusing lenses; and an oscillatory voltage source configured to apply oscillatory voltages to at least a portion of said one or more electro-dynamic lenses and said plurality of electrodes or a DC voltage source configured to apply a DC voltage to at least a portion of said one or more electro-static lenses, said one or more electro-static lenses being coupled to said plurality of electrodes having applied oscillatory voltages;

wherein at least one of (i) the spacing between adjacent electrodes, and (ii) the amplitude of the applied oscillatory voltages of said plurality of electrodes increases in the direction of ion travel.

24. The mass spectrometer, of claim 23, wherein an RF is applied to said one or more electro-dynamic focusing lenses equal in amplitude and frequency but out of phase with respect to the first electrode of said plurality of longitudinally spaced apart electrodes.

25. The mass spectrometer, of claim 23, wherein an RF is applied to said one or more electro-dynamic focusing lenses equal in amplitude and frequency but in-phase with respect to the first electrode of said plurality of longitudinally spaced apart electrodes.

26. The mass spectrometer, of claim 23, wherein a frequency applied to said first electrode of said plurality of longitudinally spaced apart electrodes is of a different frequency applied to said one or more electro-dynamic focusing lenses.

27. The mass spectrometer, of claim 26, wherein said different frequency is twice the frequency.

28. The mass spectrometer of claim 23, wherein a DC is applied to said one or more electro-static lenses having a fixed DC voltage that is related to the peak RF amplitude applied to said first lens of said plurality of longitudinally spaced apart electrodes encountered along the longitudinal direction.

29. The mass spectrometer of claim 28, wherein said outlet end of said ion transfer device is moveably positioned before the front surface of the first of said one or more electro-static focusing lenses.

30. The mass spectrometer of claim 23, wherein said one or more electro-dynamic focusing lenses comprises a plurality of electro-dynamic focusing having a same phase relationship.

31. The mass spectrometer of claim 30, wherein said same phase relationship is provided by a physical coupling.

32. The mass spectrometer, of claim 30, wherein said same phase relationship is provided by a capacitive coupling.

33. The mass spectrometer of claim 23, wherein said one or more electro-dynamic or electro-static focusing lenses comprises a single ion optic focusing lens having a thickness from about 0.6 mm up to about 8.0 mm.

34. The mass spectrometer of claim 23, wherein each of said one or more electro-dynamic or electro-static focusing lenses comprises a thickness from about 0.5 mm up to about 1.0 mm with said one or more electro-dynamic lenses providing a collective length of up to about 8 mm.

35. The mass spectrometer of claim 23, wherein said ion transfer device comprises a lateral and/or angular offset with respect to the center of said one or more electro-dynamic or electro-static focusing lenses.

36. The mass spectrometer of claim 23, wherein the oscillatory voltage source is a radio-frequency (RF) voltage source.

37. The mass spectrometer of claim 23, wherein the amplitude of the applied oscillatory voltages to said plurality of longitudinally spaced apart electrodes increases in the direction of travel.

38. The mass spectrometer of claim 23, wherein said plurality of longitudinally spaced apart electrodes comprises a first set of electrodes arranged in an interleaved relation with a plurality of a second set electrodes, wherein the oscillatory voltage applied to said first set of electrodes is opposite in phase to the oscillatory voltage applied to said second set of electrodes.

39. The mass spectrometer of claim 23, wherein the apertures of said one or more electro-dynamic or electro-static focusing lenses and said plurality of longitudinally spaced apart electrodes define at least one ion channel selected from: a substantially straight ion channel, an Shaped ion channel, and an arcuate ion channel.

40. The mass spectrometer of claim 23, wherein the spacing between adjacent electrodes of said plurality of longitudinally spaced apart electrodes increases in the direction of ion travel.

41. The mass spectrometer of claim 23, wherein said ion transfer device comprises at least one elongated capillary for carrying ions from the ion source adapted to a position within said one or more electro-dynamic.

42. The mass spectrometer of claim 23, wherein said ion transfer device comprises at least one elongated capillary for carrying ions from the ion source having an outlet end adapted to a position before said one or more electro-static lenses.

43. The mass spectrometer of claim 41, wherein said at least one elongated capillary comprises multiple ion flow channels.

44. The mass spectrometer of claim 41, wherein said at least one elongated capillary defines at an outlet end, a flow axis being angled and/or laterally offset with respect to the central longitudinal axis of said ion transport device.

45. A method for transporting and focusing ions within a low vacuum or atmospheric pressure region of a mass spectrometer, comprising:

providing one or more electro-dynamic focusing lenses electrically coupled to a first electrode that comprises a plurality of longitudinally spaced apart electrodes that in combination with said one or more electro-dynamic focusing lenses, define an ion channel along which ions may be directed;

positioning an outlet end of an ion transfer device between a flush position with the front surface of the first of said one or more electro-dynamic focusing lenses and before the back surface of a desired said one or more electro-dynamic focusing lenses;

applying oscillatory voltages to said one or more electro-dynamic focusing lenses and said plurality of longitudinally spaced apart electrodes to generate an electric field that radially confines ions within the ion channel; and increasing the radial electric field penetration in the direction of ion travel.

46. A method for transporting and focusing ions within a low vacuum or atmospheric pressure region of a mass spectrometer, comprising:

providing one or more electro-static lenses electrically coupled to a first electrode that comprises a plurality of longitudinally spaced apart electrodes that in combination with said one or more electro-static focusing lenses, define an ion channel along which ions may be directed;

positioning an outlet end of an ion transfer device between a flush position with the front surface of the first of said one or more electro-static focusing lenses and before the back surface of a desired said one or more electro-static focusing lenses;

applying RF oscillatory voltages to said plurality of longitudinally spaced apart electrodes;

applying a DC voltage to said one or more electro-static focusing lenses having a fixed DC voltage that is related to the peak RF amplitude applied to said first lens of said plurality of longitudinally spaced apart electrodes and thus generate an electric field that radially confines ions within the ion channel; and increasing the radial electric field penetration in the direction of ion travel.

* * * * *

UNITED STATES PATENT AND TRADEMARK OFFICE

CERTIFICATE OF CORRECTION

PATENT NO. : 7,915,580 B2
APPLICATION NO. : 12/252013
DATED : March 29, 2011
INVENTOR(S) : Splendore et al.

It is certified that error appears in the above-identified patent and that said Letters Patent is hereby corrected as shown below:

Col. 15, line 12, in Claim 39, replace "an Shaped ion channel" with --an S-shaped ion channel--

Col. 15, line 21, in Claim 41, after "said one or more electro-dynamic" insert --or electro-static focusing lenses--

Signed and Sealed this
Twenty-eighth Day of August, 2012

David J. Kappos

David J. Kappos
*Director of the United States Patent and Trademark Office*